US010461425B2

(12) United States Patent
Liou

(10) Patent No.: US 10,461,425 B2
(45) Date of Patent: Oct. 29, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventor: Geng-Hong Liou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/786,756

(22) Filed: Oct. 18, 2017

(65) Prior Publication Data

US 2018/0131092 A1 May 10, 2018

(30) Foreign Application Priority Data

Nov. 4, 2016 (CN) ..... 2016 1 0977565

(51) Int. Cl.

| | |
|---|---|
| ***H01Q 13/10*** | (2006.01) |
| ***H01Q 5/50*** | (2015.01) |
| ***H01Q 5/371*** | (2015.01) |
| ***H01Q 5/378*** | (2015.01) |
| ***H01Q 9/30*** | (2006.01) |
| ***H01Q 1/24*** | (2006.01) |
| ***H01Q 9/42*** | (2006.01) |
| ***H01Q 21/28*** | (2006.01) |
| ***H01Q 5/35*** | (2015.01) |
| *H01Q 1/36* | (2006.01) |

(52) U.S. Cl.

CPC ..... *H01Q 5/50* (2015.01); *H01Q 1/243* (2013.01); *H01Q 5/35* (2015.01); *H01Q 5/371* (2015.01); *H01Q 5/378* (2015.01); *H01Q 9/30* (2013.01); *H01Q 9/42* (2013.01); *H01Q 13/106* (2013.01); *H01Q 21/28* (2013.01); *H01Q 1/36* (2013.01)

(58) Field of Classification Search

CPC ..... H01Q 13/18; H01Q 9/0407; H01Q 1/286; H01Q 1/243; H01Q 1/38; H01Q 9/0421

USPC ..... 343/746, 702, 872, 878

See application file for complete search history.

(56) References Cited

U.S. PATENT DOCUMENTS

2011/0275333 A1 11/2011 Kim et al.
2013/0257659 A1* 10/2013 Darnell ..... H01Q 1/243 343/702

(Continued)

FOREIGN PATENT DOCUMENTS

| | | | |
|---|---|---|---|
| CN | 103390793 | A | 11/2013 |
| CN | 105390801 | A | 3/2016 |
| CN | 105958201 | A | 9/2016 |

*Primary Examiner* — Hai V Tran
*Assistant Examiner* — Collin Dawkins
(74) *Attorney, Agent, or Firm* — ScienBiziP, P.C.

(57) ABSTRACT

An antenna structure includes a metallic member, a feed portion, a ground portion, and a radiator. The metallic member defines at least one slot and is divided into a first combining portion and a second combining portion by the at least one slot. The feed portion feeds current to the first combining portion. The ground portion grounds the first combining portion. The radiator feeds current to the second combining portion. The first combining portion, the feed portion, and the ground portion cooperatively form a first antenna to activate a first mode for generating radiation signals in a first frequency band. The second combining portion and the radiator cooperatively form a second antenna to activate a second mode for generating radiation signals in a second frequency band.

19 Claims, 12 Drawing Sheets

(56) References Cited

U.S. PATENT DOCUMENTS

2014/0111381 A1* 4/2014 Lin ..... H01Q 9/04
343/700 MS
2015/0188212 A1* 7/2015 Tseng ..... H01Q 1/243
343/702

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201610977565.4 filed on Nov. 4, 2016, the contents of which are incorporated by reference herein.

FIELD

The subject matter herein generally relates to an antenna structure and a wireless communication device using the antenna structure.

BACKGROUND

Metal housings are widely used for wireless communication devices, such as mobile phones or personal digital assistants (PDAs). Antennas are also important components in wireless communication devices for receiving and transmitting wireless signals at different frequencies, such as wireless signals operated in a long term evolution (LTE) band. However, when the antenna is located in the metal housing, the antenna signals are often shielded by the metal housing. This can degrade the operation of the wireless communication device.

BRIEF DESCRIPTION OF THE DRAWINGS

Implementations of the present technology will now be described, by way of example only, with reference to the attached figures.

DETAILED DESCRIPTION

Figure 1:
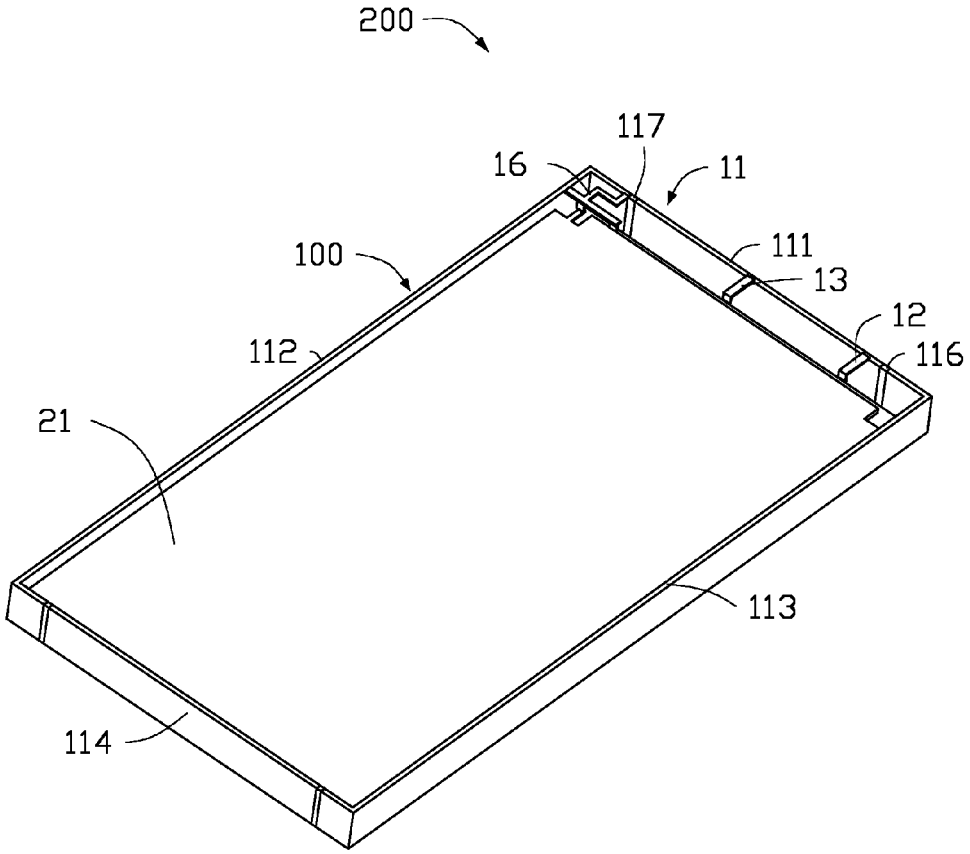
FIG. 1 is an isometric view of a first exemplary embodiment of a portion of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

Figure 2:
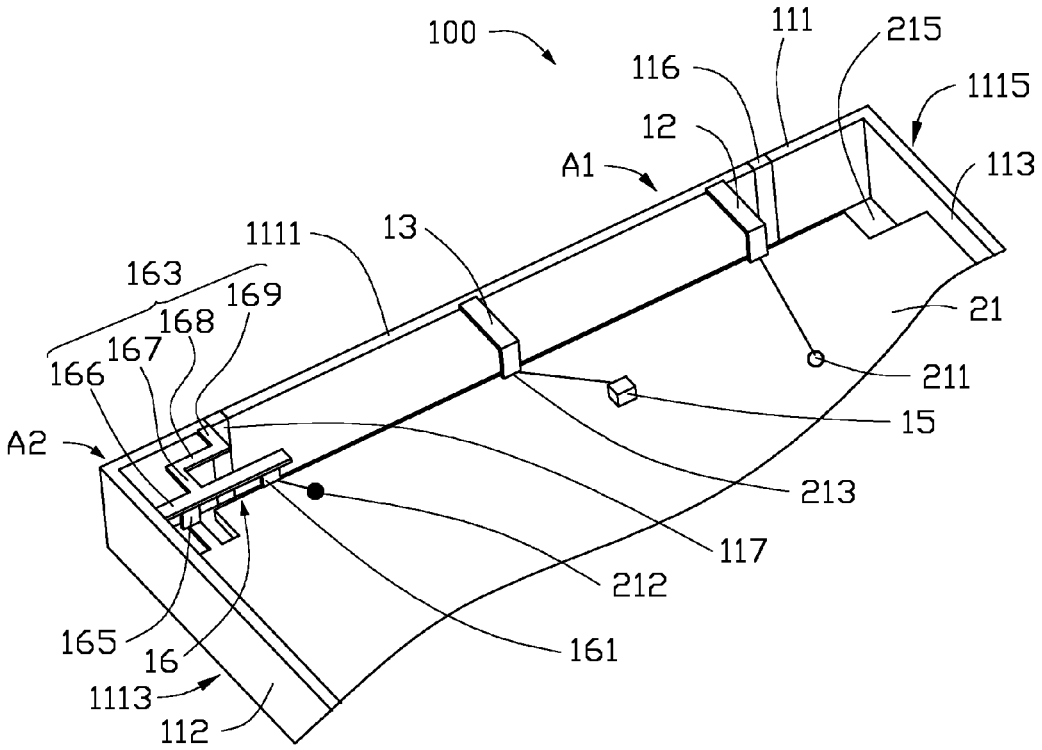
FIG. 2 is similar to FIG. 1, but shown from another angle.

FIGS. 1 and 2 illustrate an embodiment of portions of a wireless communication device 200 using a first exemplary antenna structure 100. The wireless communication device 200 can be a mobile phone or a personal digital assistant, for example. The antenna structure 100 is configured to receive and/or send wireless signals.

The wireless communication device 200 further includes a baseboard 21. The baseboard 21 can be made of a dielectric material, such as glass epoxy phenolic fiber (FR4). The baseboard 21 includes a first feed point 211, a second feed point 212, and a ground point 213. The first feed point 211 and the second feed point 212 are positioned on the baseboard 21 and are spaced apart from each other. The first feed point 211 and the second feed point 212 both feed current to the antenna structure 100. The ground point 213 is positioned on the baseboard 21 between the first feed point 211 and the second feed point 212. The ground point 213 is configured to ground the antenna structure 100.

The baseboard 21 further includes a keep-out-zone 215. The keep-out-zone 215 is positioned at a side of the baseboard 21. The purpose of the keep-out-zone 215 is to delineate an area on the baseboard 21 from which other electronic elements (such as a camera, a vibrator, a speaker, a battery, a charge coupled device, etc.) are excluded, to prevent the electronic element from interfering with the antenna structure 100. In this exemplary embodiment, the keep-out-zone 215 has dimensions of about 74*5 $mm^2$.

The antenna structure 100 includes a metallic member 11, a feed portion 12, a ground portion 13, a first switching circuit 15, and a radiator 16.

The metallic member 11 can be decorative, for example, an external metallic frame of the wireless communication device 200. In this exemplary embodiment, the metallic member 11 is a frame structure and includes a first frame 111, a second frame 112, a third frame 113, and a fourth frame 114. The first frame 111 is spaced apart from and parallel to the fourth frame 114. The second frame 112 is spaced apart from and parallel to the third frame 113. The second frame 112 and the third frame 113 are connected to ends of the first frame 111 and ends of the fourth frame 114. The first frame 111, the second frame 112, the third frame 113, and the fourth frame 114 cooperatively surround the baseboard 21. The first frame 111 is positioned adjacent to the keep-out-zone 115.

The first frame 111 defines two slots, a first slot 116 and a second slot 117. A width of the first slot 116 is of about 0.8-2.0 mm. A width of the second slot 117 is of about 0.8-2.0 mm. In this exemplary embodiment, a width of the first slot 116 and a width of the second slot 117 are both 1.5 mm.

The metallic member 11 is divided into three portions by the first slot 116 and the second slot 117. The portion of the metallic member 11 between the first slot 116 and the second slot 117 forms a first combining portion 1111. The portion of the metallic member 11 positioned at a side of the second slot 117 and away from the first combining portion 1111 forms a second combining portion 1113. The portion of the metallic member 11 positioned at a side of the first slot 116 and away from the first combining portion 1111 forms a third combining portion 1115. In this exemplary embodiment, the second combining portion 1113 and the third combining portion 1115 are both electrically connected to a ground plane of the baseboard 21 through at least one ground point, to ground the antenna structure 100.

The feed portion 12 is positioned adjacent to the first slot 116. One end of the feed portion 12 is electrically connected to the first feed point 211 through an antenna separation filter (not shown). Another end of the feed portion 12 is electrically connected to the first combining portion 1111. When the first feed point 211 supplies current, the current flows to the first combining portion 1111 through the feed portion 12, and flows to the ground point 213 through the ground portion 13. Then the first combining portion 1111 acts as a first antenna A1 of the antenna structure 100 to activate a first mode for generating radiation signals in a first frequency band. In this exemplary embodiment, the first mode is a low frequency operation mode.

Figure 3:
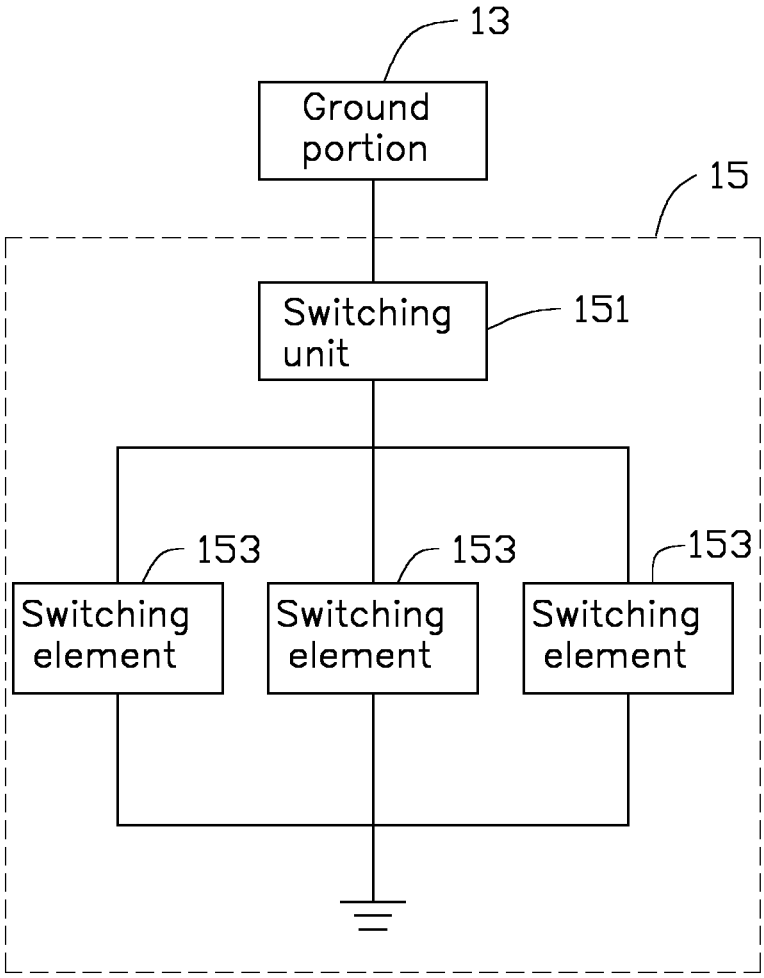
FIG. 3 is a circuit diagram of a first switching circuit of the antenna structure of FIG. 1.

As illustrated in FIG. 3, the first switching circuit 15 includes a switching unit 151 and a plurality of switching elements 153. In this exemplary embodiment, the first switching circuit 15 includes three switching elements 153. The three switching elements 153 are all inductors and have respective inductance values of about 9 nH, 12 nH, and 22 nH. The switching unit 151 is electrically connected to the ground portion 13. The switching elements 153 are connected in parallel. One end of each switching element 153 is electrically connected to the switching unit 151. The other end of each switching element 153 is grounded. Through controlling the switching unit 151, the first combining portion 1111 can be switched to connect with different switching elements 153. Since each switching element 153 has a different inductance value, the first frequency band of the first mode of the first antenna A1 can be adjusted through switching the switching unit 151.

For example, when the switching unit 151 is switched to connect with the switching element 153 having an inductance value of about 9 nH, the antenna structure 100 can work at a frequency band of LTE-A Band 8 (880-960 MHz). When the switching unit 151 is switched to connect with the switching element 153 having an inductance value of about 12 nH, the antenna structure 100 can work at a frequency band of LTE-A Band 5 (824-894 MHz). When the switching unit 151 is switched to connect with the switching element 153 having an inductance value of about 22 nH, the antenna structure 100 can work at a frequency band of LTE-A Band 17 (704-746 MHz).

In other exemplary embodiments, the switching elements 153 are not limited to being inductors, and can be capacitors or a combination of inductor and capacitor. A number of the switching elements 153 can also be adjustable.

As illustrated in FIG. 2, the radiator 16 is positioned adjacent to the second combining portion 1113 and is also positioned above the keep-out-zone 215. The radiator 16 includes a feed section 161, a radiating portion 163, and a ground section 165. The feed section 161 is substantially rectangular. The feed section 161 is positioned at a plane perpendicular to a plane on which the baseboard 21 is positioned. One end of the feed section 161 is electrically connected to the second feed point 212 through a feed line, a metallic sharp, a probe or other connecting elements. Another end of the feed section 161 is electrically connected to the radiating portion 163 to feed current to the radiating portion 163.

The radiating portion 163 is positioned at a plane parallel to a plane on which the baseboard 21 is positioned. The radiating portion 163 includes a first radiating section 166, a second radiating section 167, a third radiating section 168, and a fourth radiating section 169.

The first radiating section 166 is substantially rectangular. One end of the first radiating section 166 is perpendicularly connected to the feed section 161. Another end of the first radiating section 166 extends along a direction parallel to the first frame 111 towards the second frame 112. The extension continues until the first radiating section 166 is electrically connected to the second frame 112.

The second radiating section 167 is substantially rectangular. The second radiating section 167 is perpendicularly connected to a side of the first radiating section 166 adjacent to the first frame 111 and extends along a direction parallel to the second frame 112 and towards the first frame 111. The third radiating section 168 is substantially rectangular. The third radiating section 168 is perpendicularly connected to an end of the second radiating section 167 away from the first radiating section 166 and extends along a direction parallel to the first radiating section 166 towards the third frame 113.

The fourth radiating section 169 is substantially rectangular. One end of the fourth radiating section 169 is perpendicularly connected to one end of the third radiating section 168 away from the second radiating section 167. Another end of the fourth radiating section 169 extends along a direction parallel to the second radiating section 167 towards the first frame 111. The extension continues until the fourth radiating section 169 is electrically connected to one end of the first frame 111 adjacent to the second slot 117.

The ground section 165 is positioned at a plane perpendicular to the plane on which the baseboard 21 is positioned. One end of the ground section 165 is electrically connected to one end of the first radiating section 166 adjacent to the second frame 112. Another end of the ground section 165 is grounded through a matching circuit (not shown).

When the second feed point 212 supplies a current, the current flows to the radiating portion 163 through the feed section 161 and is grounded through the ground section 165, so that the second combining portion 1113 and the radiator 16 cooperatively form a second antenna A2 of the antenna structure 100 to activate a second mode for generating radiation signals in a second frequency band. In this exemplary embodiment, the second mode is a high frequency operation mode. The matching circuit is used to adjust and optimize an impedance of the antenna structure 100.

Figure 4:
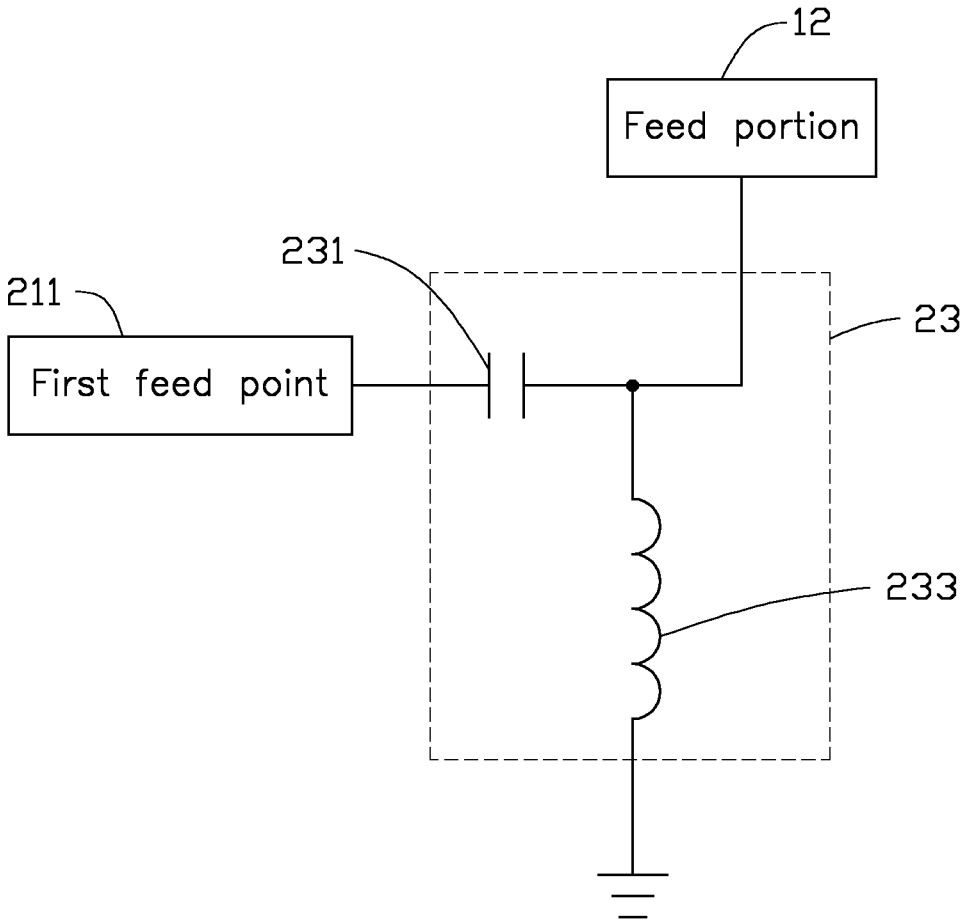
FIG. 4 is a circuit diagram of a first matching circuit of the antenna structure of FIG. 1.
Figure 5:
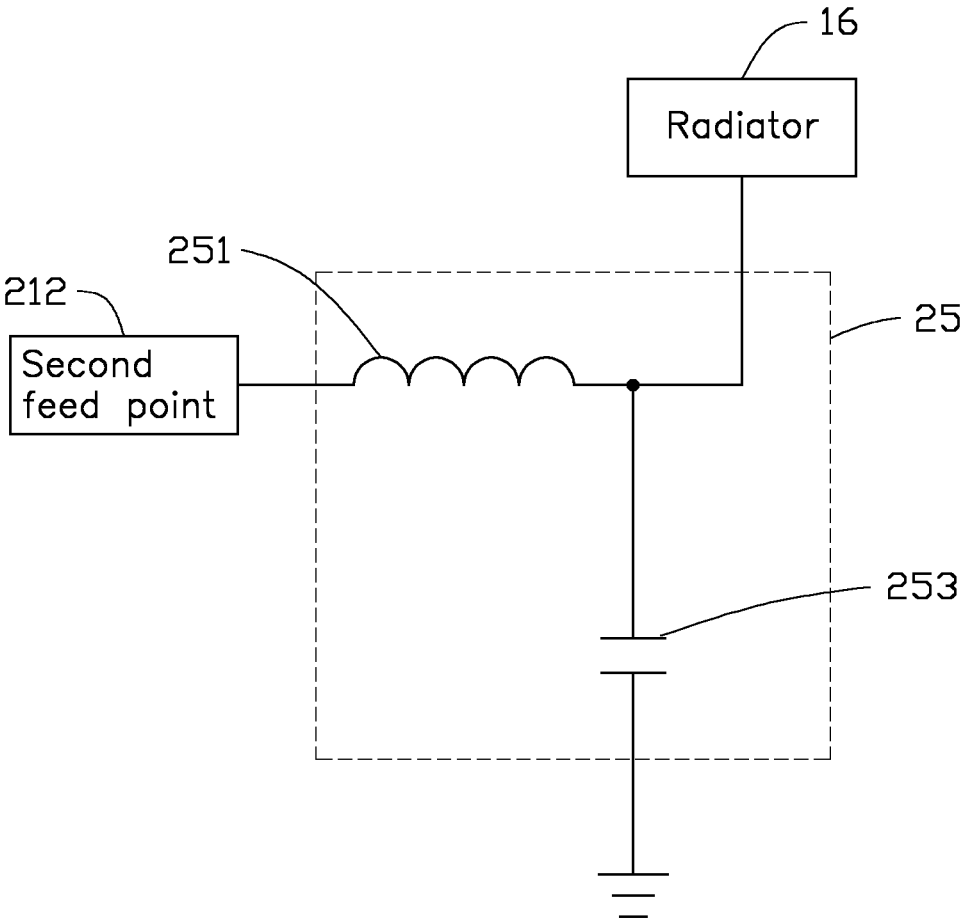
FIG. 5 is a circuit diagram of a second matching circuit of the antenna structure of FIG. 1.

As illustrated in FIG. 4, in another exemplary embodiment, the first feed point 211 can also be electrically connected to the feed portion 12 through a first matching circuit 23. As illustrated in FIG. 5, in another exemplary embodiment, the second feed point 212 can be electrically connected to the radiator 16 through a second matching circuit 25.

In this exemplary embodiment, the first matching circuit 23 includes a first matching element 231 and a second matching element 233. One end of the first matching element 231 is electrically connected to the first feed point 211. Another end of the first matching element 231 is electrically connected to one end of the second matching element 233 and the feed portion 12. Another end of the second matching element 233 is grounded.

In this exemplary embodiment, the first matching element 231 is a capacitor having a capacitance value of about 1.5 pF. The second matching element 233 is an inductor having an inductance value of about 16 nH. In other exemplary embodiments, the first matching element 231 can be an inductor or a combination of inductor and capacitor. The second matching element 233 can be a capacitor or the combination.

As illustrated in FIG. 5, in this exemplary embodiment, the second matching circuit 25 includes a third matching element 251 and a fourth matching element 253. One end of the third matching element 251 is electrically connected to the second feed point 212. Another end of the third matching element 251 is electrically connected to an end of the fourth matching element 253 and the radiator 16. Another end of the fourth matching element 253 is grounded.

In this exemplary embodiment, the third matching element 251 is an inductor having an inductance value of about 8 nH. The fourth matching element 253 is a capacitor having a capacitance value of about 500 fF. In other exemplary embodiments, the third matching element 251 can be a capacitor or a combination of inductor and capacitor. The fourth matching element 253 can be an inductor or the combination.

Figure 6:
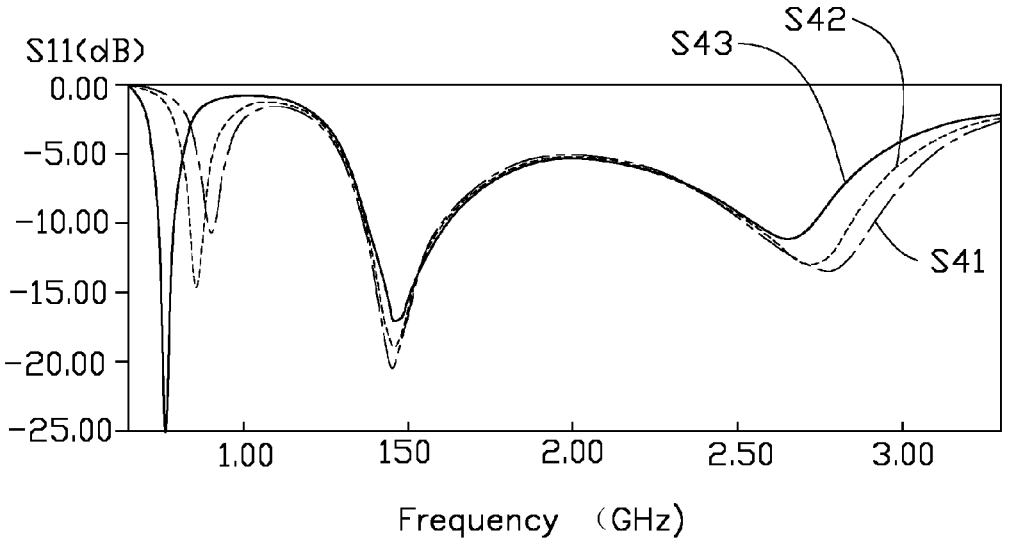
FIG. 6 is a scattering parameter graph of the antenna structure of FIG. 1.

FIG. 6 illustrates a scattering parameter graph of the antenna structure 100. Curve S41 illustrates a scattering parameter of the antenna structure 100 when the first switching circuit 15 switches to a switching element 153 having an inductance value of about 9 nH. Curve S42 illustrates a scattering parameter of the antenna structure 100 when the first switching circuit 15 switches to a switching element 153 having an inductance value of about 12 nH. Curve S43 illustrates a scattering parameter of the antenna structure 100 when the first switching circuit 15 switches to a switching element 153 having an inductance value of about 22 nH.

Referring to curves S41-S43, when the first switching circuit 15 switches to different switching elements 153, the antenna structure 100 can work at different low frequency bands, for example, a frequency band of LTE-A Band 8 (880-960 MHz, GSM900), a frequency band of LTE-A Band 5 (824-894 MHz, GSM850), and a frequency band of LTE-A Band 17 (704-746 MHz, BTE band 17). Additionally, the antenna structure 100 can work at a high frequency band, for example, GSM1800/1900, UMTS 2100, LTE-A Band 7, which can also satisfy a design of the antenna.

Figure 7:
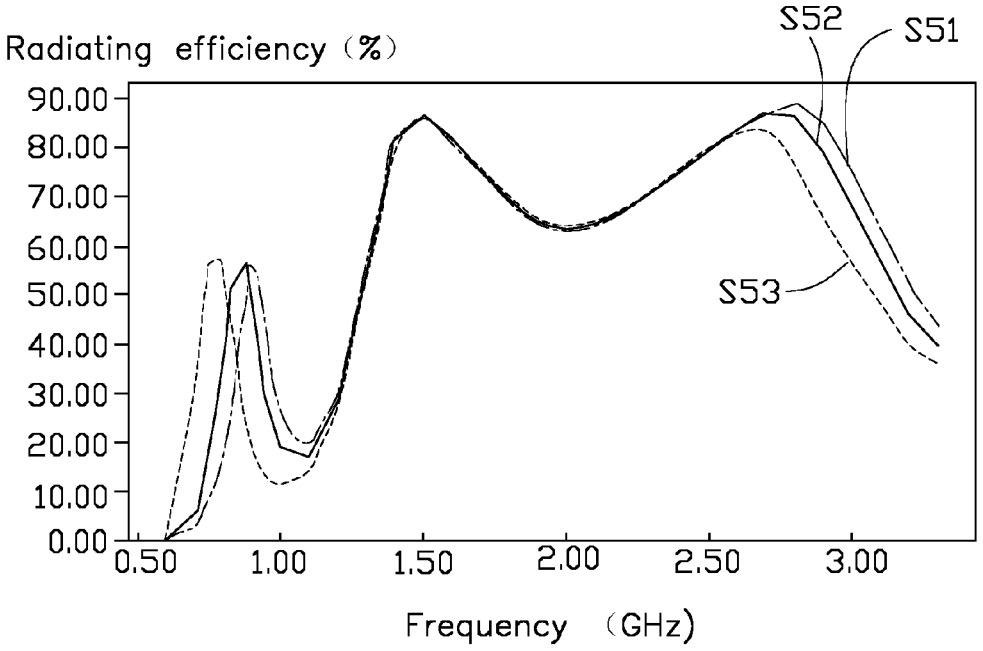
FIG. 7 is a radiating efficiency graph of the antenna structure of FIG. 1.

FIG. 7 illustrates a radiating efficiency graph of the antenna structure 100. Curve S51 illustrates a radiating efficiency of the antenna structure 100 when the first switching circuit 15 switches to a switching element 153 having an inductance value of about 9 nH. Curve S52 illustrates a radiating efficiency of the antenna structure 100 when the first switching circuit 15 switches to a switching element 153 having an inductance value of about 12 nH. Curve S53 illustrates a radiating efficiency of the antenna structure 100 when the first switching circuit 15 switches to a switching element 153 having an inductance value of about 22 nH.

In viewing curves S51-S53, through switching the first switching circuit 15, the antenna structure 100 can completely cover a system bandwidth required by multiple communication systems, such as GSM/WCDMA/LTE, and satisfy a design of the antenna. The antenna structure 100 also has a good radiating efficiency, for example, a radiating efficiency of the antenna structure 100 is above 45%.

As described above, the antenna structure 100 supplies current to the first combining portion 1111 through the first feed point 211 and forms the first antenna A1 to generate a multi-band operation bandwidth. The antenna structure 100 further includes the first switching circuit 15, through switching the first switching circuit 15, the antenna structure 100 can work at GSM/WCDMA/LTE systems. The antenna structure 100 includes the second antenna A2, satisfying a need of carrier aggregation (CA) technology of LTE-Advanced, for example, LTE-A Band 3 frequency band and LTE-A Band 7 frequency band, and/or LTE-A Band 20 frequency band and LTE-A Band 7 frequency band. That is, the wireless communication device 200 can use the first antenna A1 and the second antenna A2 to receive and/or transmit wireless signals at multiple frequency bands simultaneously and utilize the CA technology.

Figure 8:
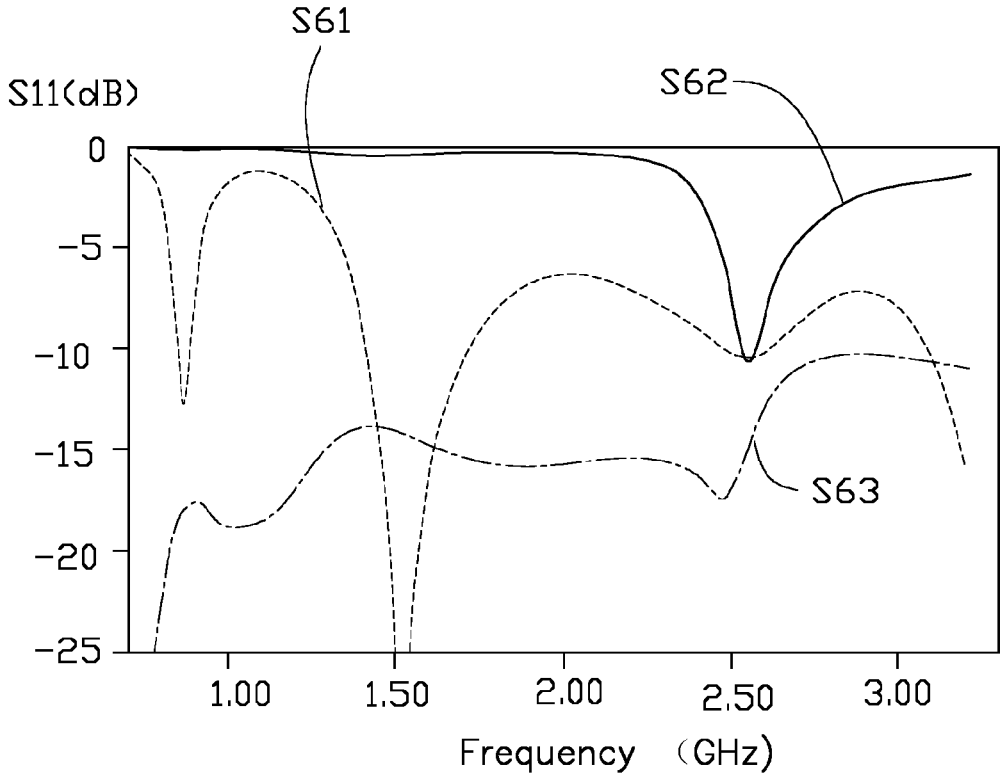
FIG. 8 is a scattering parameter graph when the antenna structure of FIG. 1 works at frequency bands of LTE-A Band 5 and LTE-A Band 7 through carrier aggregation (CA) technology.

FIG. 8 illustrates a scattering parameter graph when the antenna structure 100 works at frequency bands of LTE-A Band 5 and LTE-A Band 7 through CA technology. Curve S61 illustrates a scattering parameter of the first antenna A1 when the first switching circuit 15 switches to a switching element 153 having an inductance value of about 12 nH. Curve S62 illustrates a scattering parameter of the second antenna A2 when the ground section 165 is grounded through a capacitor having a capacitance value of about 0.8 pF. Curve S63 illustrates an isolation when the antenna structure 100 works simultaneously at the frequency bands of LTE-A Band 5 and LTE-A Band 7. When the wireless communication device 200 uses the CA technology to receive and/or transmit wireless signals at two different frequency bands simultaneously (for example, frequency bands of LTE-A Band 5 and LTE-A Band 7), an isolation of the wireless communication device 200 is about −10 dB, which satisfies a design of the antenna.

In other exemplary embodiments, the ground section 165 of the second antenna A2 can be grounded through a second switching circuit (not shown). The detail circuit and working principle of the second switching circuit are in accord with the first switching circuit 15 in FIG. 3. Through switching the second switching circuit, the second antenna A2 can work at different frequency bands and realize a combination of different frequency bands. For example, through switching the second switching circuit, the second antenna A2 can only work at a Global Positioning System (GPS) frequency band. Through switching the second switching circuit, the second antenna A2 can only work at a BT frequency band or a WIFI frequency band. Through switching the second switching circuit, the second frequency band of the second mode can be adjustable, and the second antenna A2 can work at the GPS frequency band and LTE-A Band 7 frequency band. Through switching the second switching circuit, the second antenna A2 can work at the GPS frequency band and BT frequency band, or work at the GPS frequency band and WIFI frequency band.

Figure 9:
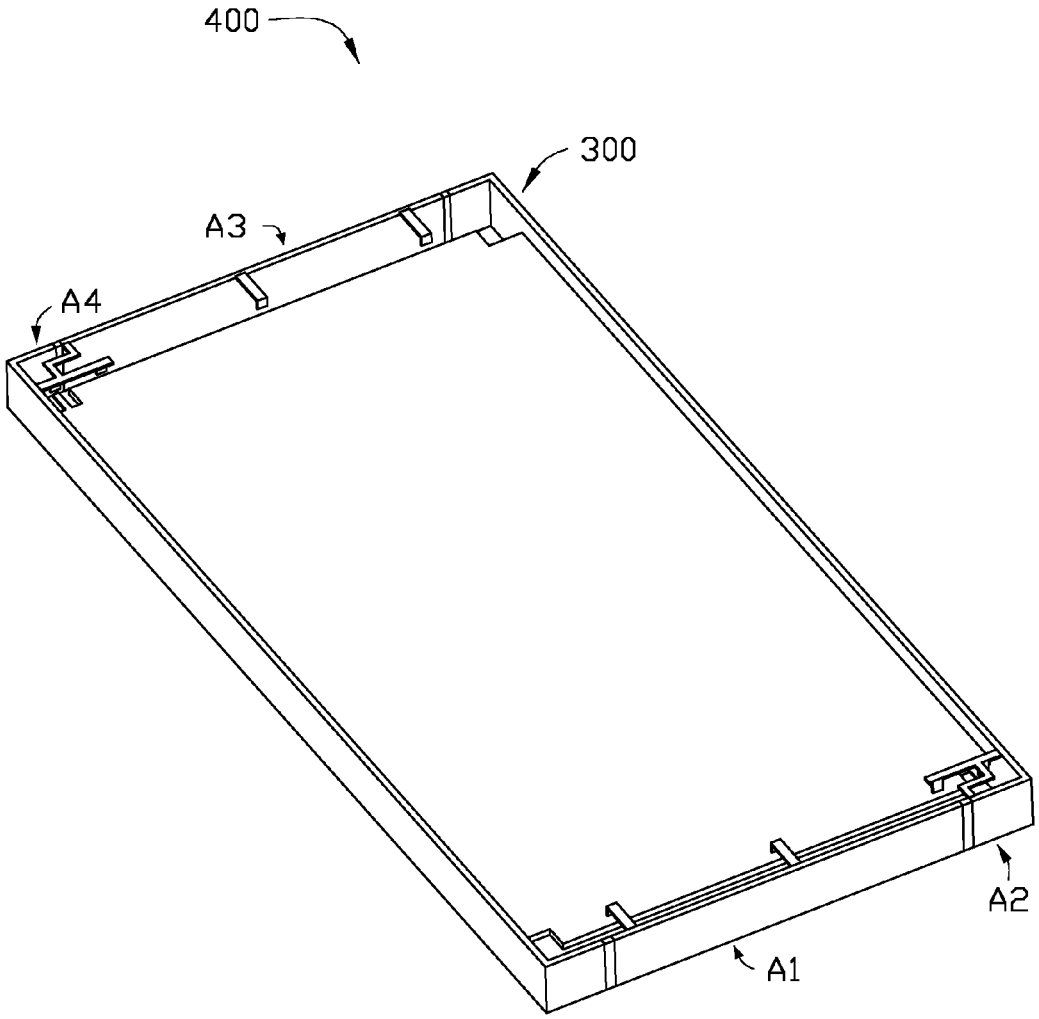
FIG. 9 is an isometric view of a second exemplary embodiment of a wireless communication device using a second exemplary antenna structure.

FIG. 9 illustrates a second exemplary embodiment of a wireless communication device 400. The wireless communication device 400 differs from the wireless communication device 200 in that the wireless communication device 400 further includes a third antenna A3 and a fourth antenna A4. The third antenna A3 and the fourth antenna A4 are positioned opposite to the first antenna A1 and the second antenna A2. That is, the third antenna A3 and the fourth antenna A4 are positioned at another end of the wireless communication device 400. In this exemplary embodiment, a structure of the third antenna A3 is the same as the structure of the first antenna A1. A structure of the fourth antenna A4 is the same as the structure of the second antenna A2.

Figure 10:
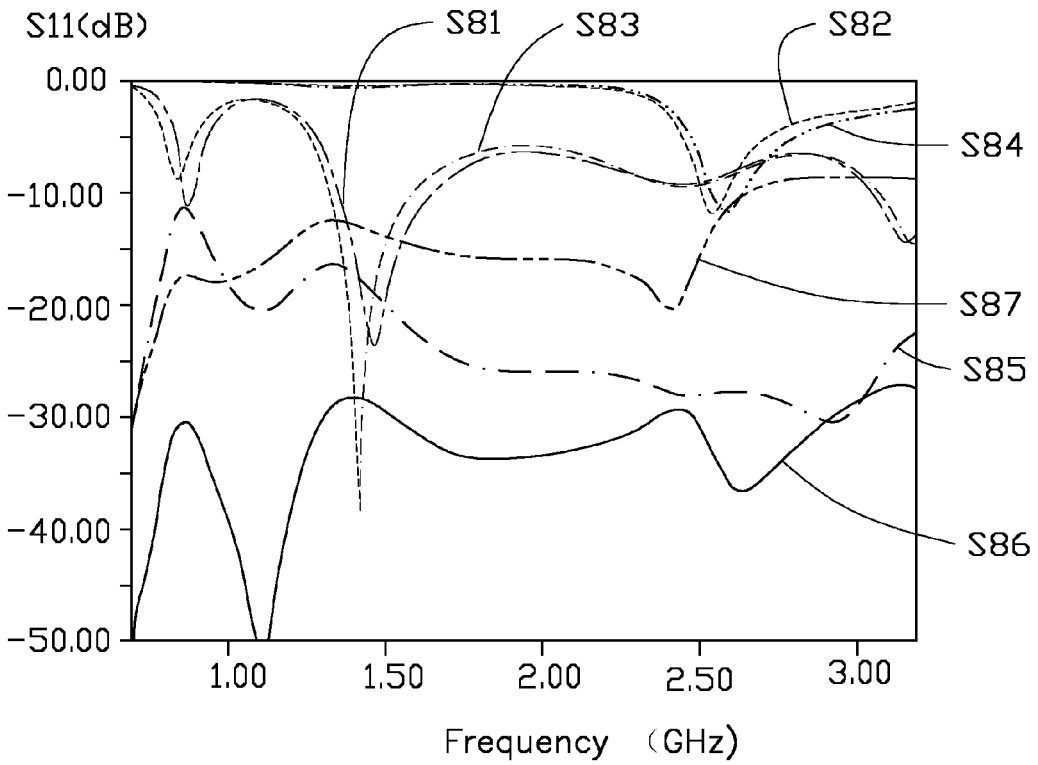
FIGS. 10-12 are scattering parameter graphs of when the antenna structure of FIG. 9 works at frequency bands of LTE-A Band 5 and LTE-A Band 7 through carrier aggregation (CA) technology.
Figure 11:
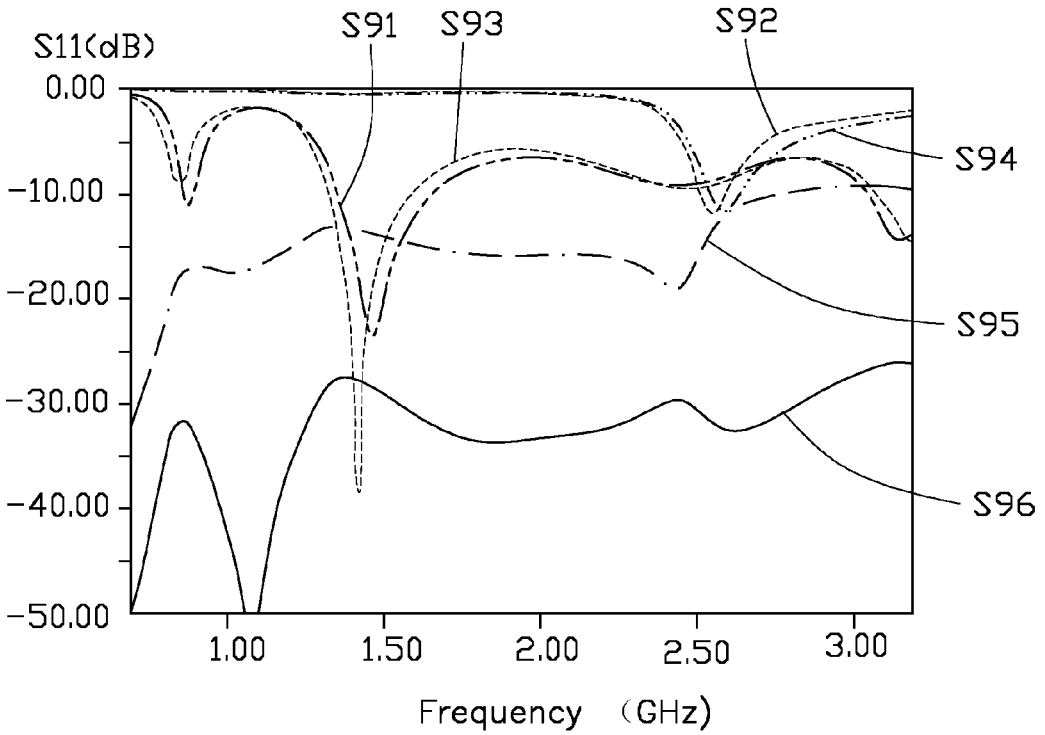
Figure 12:
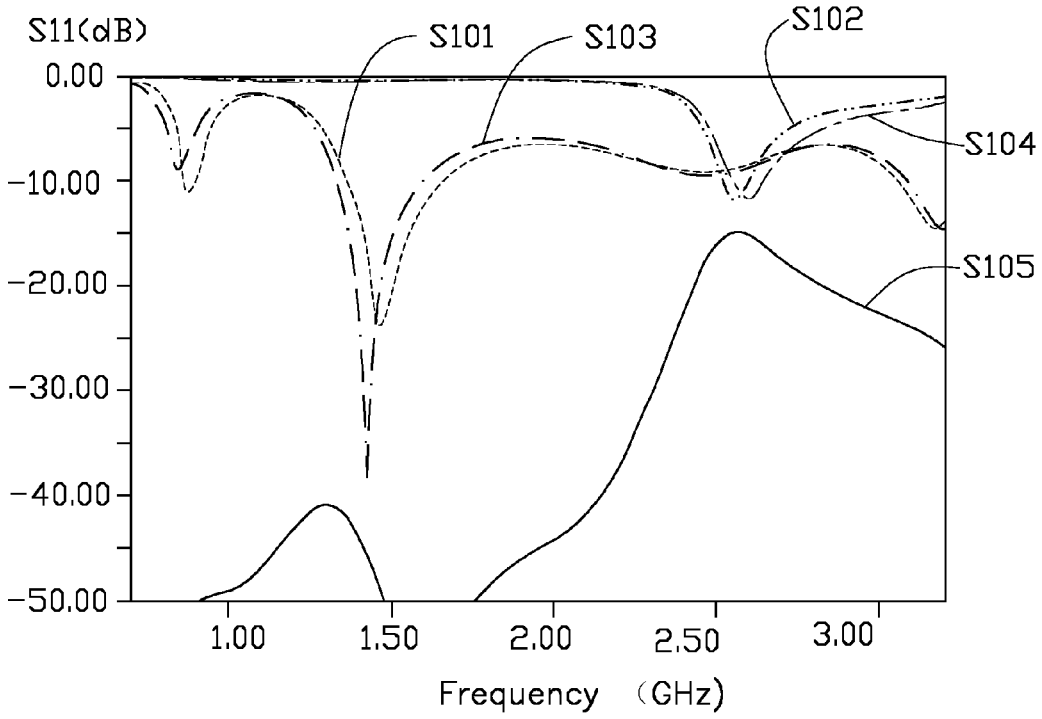

In this exemplary embodiment, the first antenna A1 is a main antenna. The third antenna A3 is a diversity antenna. FIGS. 10-12 illustrate a scattering parameter graph when the antenna structure 300 works at frequency bands of LTE-A Band 5 and LTE-A Band 7 through CA technology. Curves S81, S91, and S101 each illustrate a scattering parameter when the third antenna A3 of the antenna structure 300 works at LTE-A Band 5 frequency band. Curves S82, S92, and S102 each illustrate a scattering parameter when the fourth antenna A4 of the antenna structure 300 works at LTE-A Band 7 frequency band. Curves S83, S93, and S103 each illustrate a scattering parameter when the first antenna A1 of the antenna structure 300 works at LTE-A Band 5 frequency band. Curves S84, S94, and S104 each illustrate a scattering parameter when the second antenna A2 of the antenna structure 300 works at LTE-A Band 7 frequency band.

Curve S85 illustrates an isolation between the first antenna A1 and the third antenna A3 of the antenna structure 300. Curve S86 illustrates an isolation between the third antenna A3 and the fourth antenna A4 of the antenna structure 300. Curve S87 illustrates an isolation between the second antenna A2 and the third antenna A3 of the antenna structure 300. Curve S95 illustrates an isolation between the first antenna A1 and the second antenna A2 of the antenna structure 300. Curve S96 illustrates an isolation between the first antenna A1 and the fourth antenna A4 of the antenna structure 300. Curve S105 illustrates an isolation between the second antenna A2 and the fourth antenna A4 of the antenna structure 300. When the wireless communication device 400 uses CA technology to receive and/or transmit wireless signals at two different frequency bands simultaneously (for example, frequency bands of LTE Band 5 and LTE Band 7), isolations between two different antennas are all below −10 dB, which satisfy a design of the antenna.

In other exemplary embodiments, the third antenna A3 can be a diversity antenna and the fourth antenna A4 can be a GPS antenna. The wireless communication device 400 can further include an additional duplexer to achieve a separation of signals.

The antenna structure 100/300 defines two slots on the metallic member 11 to divide the metallic member 11 into three combining portions. One of the three combining portions forms the first antenna A1 of the antenna structure 100/300 to generate multiple frequency bands. The antenna structure 100/300 further includes the first switching circuit 15, then the frequencies at the low frequency band can be adjustable to cover GSM/WCDMA/LTE systems. In addition, another of the three combining portions forms the second antenna A2 of the antenna structure 100/300 to meet a demand for LTE CA technology.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a metallic member, the metallic member defining at least one slot and being divided into a first combining portion and a second combining portion by the at least one slot;

a feed portion, the feed portion electrically connected to the first combining portion and configured to feed current to the first combining portion;

a ground portion, the ground portion electrically connected to the first combining portion and configured to ground the first combining portion; and a radiator, the radiator electrically connected to the second combining portion and configured to feed current to the second combining portion; wherein the radiator comprises a feed section, a radiating portion, and a ground section, the feed section is electrically connected to the radiating portion to feed current to the radiating portion, the radiating portion is positioned at a plane perpendicular to a plane of the feed section, the radiating portion comprises a first radiating section, a second radiating section, a third radiating section, and a fourth radiating section; wherein one end of the first radiating section is perpendicularly connected to the feed section, and another end of the first radiating section is electrically connected to the metallic member; wherein the second radiating section is perpendicularly connected to the first radiating section, and the third radiating section is perpendicularly connected to an end of the second radiating section away from the first radiating section; wherein one end of the fourth radiating section is perpendicularly connected to one end of the third radiating section away from the second radiating section, and another end of the fourth radiating section is electrically connected to the metallic member; wherein one end of the ground section is electrically connected to one end of the first radiating section, and another end of the ground section is grounded;

wherein the first combining portion, the feed portion, and the ground portion cooperatively form a first antenna of the antenna structure, the second combining portion and the radiator cooperatively form a second antenna of the antenna structure, the first antenna activates a first mode to generate radiation signals in a first frequency band, and the second antenna activates a second mode to generate radiation signals in a second frequency band.

2. The antenna structure of claim 1, wherein the metallic member comprises a first frame, a second frame, a third frame, and a fourth frame, the first frame is spaced apart from and parallel to the fourth frame, the second frame is positioned apart from and parallel to the third frame, the second frame and the third frame are respectively connected to two ends of the first frame and the fourth frame; wherein the at least one slot comprises a first slot and a second slot, the first slot and the second slot are defined on the first frame; wherein the portion of the metallic member between the first slot and the second slot forms the first combining portion, the portion of the metallic member positioned at a side of the second slot and away from the first combining portion forms the second combining portion, the portion of the metallic member positioned at a side of the first slot and away from the first combining portion forms a third combining portion, and the second combining portion and the third combining portion are both grounded.

3. The antenna structure of claim 2, wherein wherein the another end of the first radiating section extends along a direction parallel to the first frame towards the second frame until the first radiating section is electrically connected to the second frame; wherein the second radiating section is perpendicularly connected to a side of the first radiating section adjacent to the first frame and extends along a direction parallel to the second frame and towards the first frame, the third radiating section extends along a direction parallel to the first radiating section towards the third frame; wherein the another end of the fourth radiating section extends along a direction parallel to the second radiating section towards the first frame until the fourth radiating section is electrically connected to one end of the first frame adjacent to the second slot.

4. The antenna structure of claim 1, further comprising a first switching circuit, wherein the first switching circuit comprises a switching unit and a plurality of switching elements, the switching unit is electrically connected to the ground portion, the switching elements are connected in parallel, one end of each switching element is electrically connected to the switching unit, and the other end of each switching element is grounded; wherein through controlling the switching unit, the switching unit switches to connect with different switching elements to adjust the first frequency band.

5. The antenna structure of claim 1, further comprising a first matching circuit, wherein the first matching circuit comprises a first matching element and a second matching element, one end of the first matching element is electrically connected to a first feed point, another end of the first matching element is electrically connected to one end of the second matching element and the feed portion, another end of the second matching element is grounded.

6. The antenna structure of claim 1, further comprising a second matching circuit, wherein the second matching circuit comprises a third matching element and a fourth matching element, one end of the third matching element is electrically connected to a second feed point, another end of the third matching element is electrically connected to an end of the fourth matching element and the radiator, another end of the fourth matching element is grounded.

7. The antenna structure of claim 1, further comprising a third antenna and a fourth antenna, wherein the third antenna and the fourth antenna are positioned opposite to the first antenna and the second antenna, the third antenna and the fourth antenna are positioned adjacent to the fourth frame, a structure of the third antenna is the same as the structure of the first antenna, and a structure of the fourth antenna is the same as the structure of the second antenna.

8. The antenna structure of claim 7, wherein the first antenna is a main antenna and the third antenna is a diversity antenna.

9. The antenna structure of claim 7, wherein the third antenna is a diversity antenna and the fourth antenna is a Global Positioning System (GPS) antenna, the third antenna and the fourth antenna are both electrically connected to a duplexer to achieve a separation of signals.

10. A wireless communication device comprising:

an antenna structure comprising:

a metallic member, the metallic member defining at least one slot and being divided into a first combining portion and a second combining portion by the at least one slot;

a feed portion, the feed portion electrically connected to the first combining portion and configured to feed current to the first combining portion;

a ground portion, the ground portion electrically connected to the first combining portion and configured to ground the first combining portion; and a radiator, the radiator electrically connected to the second combining portion and configured to feed current to the second combining portion; wherein the radiator comprises a feed section, a radiating portion, and a ground section, the feed section is electrically connected to the radiating portion to feed current to the radiating portion, the radiating portion is positioned at a plane perpendicular to a plane of the feed section, the radiating portion comprises a first radiating section, a second radiating section, a third radiating section, and a fourth radiating section; wherein one end of the first radiating section is perpendicularly connected to the feed section, and another end of the first radiating section is electrically connected to the metallic member; wherein the second radiating section is perpendicularly connected to the first radiating section, and the third radiating section is perpendicularly connected to an end of the second radiating section away from the first radiating section; wherein one end of the fourth radiating section is perpendicularly connected to one end of the third radiating section away from the second radiating section, and another end of the fourth radiating section is electrically connected to the metallic member; wherein one end of the ground section is electrically connected to one end of the first radiating section, and another end of the ground section is grounded;

wherein the first combining portion, the feed portion, and the ground portion cooperatively form a first antenna of the antenna structure, the second combining portion and the radiator cooperatively form a second antenna of the antenna structure, the first antenna activates a first mode to generate radiation signals in a first frequency band, and the second antenna activates a second mode to generate radiation signals in a second frequency band.

11. The wireless communication device of claim 10, further comprising a baseboard, wherein the metallic member surrounds the baseboard, the baseboard comprises a first feed point, a second feed point, and a ground point, the first feed point is electrically connected to the feed portion, the second feed point is electrically connected to the radiator, and the ground point is electrically connected to the ground portion.

12. The wireless communication device of claim 11, wherein the antenna structure further comprises a first matching circuit, the first matching circuit comprises a first matching element and a second matching element, one end of the first matching element is electrically connected to the first feed point, another end of the first matching element is electrically connected to one end of the second matching element and the feed portion, another end of the second matching element is grounded.

13. The wireless communication device of claim 11, wherein the antenna structure further comprises a second matching circuit, the second matching circuit comprises a third matching element and a fourth matching element, one end of the third matching element is electrically connected to the second feed point, another end of the third matching element is electrically connected to an end of the fourth matching element and the radiator, another end of the fourth matching element is grounded.

14. The wireless communication device of claim 10, wherein the metallic member comprises a first frame, a second frame, a third frame, and a fourth frame, the first frame is spaced apart from and parallel to the fourth frame, the second frame is positioned apart from and parallel to the third frame, the second frame and the third frame are respectively connected to two ends of the first frame and the fourth frame; wherein the at least one slot comprises a first slot and a second slot, the first slot and the second slot are defined on the first frame; wherein the portion of the metallic member between the first slot and the second slot forms the first combining portion, the portion of the metallic member positioned at a side of the second slot and away from the first combining portion forms the second combining portion, the portion of the metallic member positioned at a side of the first slot and away from the first combining portion forms a third combining portion, and the second combining portion and the third combining portion are both grounded.

15. The wireless communication device of claim 14, wherein wherein the another end of the first radiating section extends along a direction parallel to the first frame towards the second frame until the first radiating section is electrically connected to the second frame; wherein the second radiating section is perpendicularly connected to a side of the first radiating section adjacent to the first frame and extends along a direction parallel to the second frame and towards the first frame, the third radiating section extends along a direction parallel to the first radiating section towards the third frame; wherein the another end of the fourth radiating section extends along a direction parallel to the second radiating section towards the first frame until the fourth radiating section is electrically connected to one end of the first frame adjacent to the second slot.

16. The wireless communication device of claim 10, wherein the antenna structure further comprises a first switching circuit, the first switching circuit comprises a switching unit and a plurality of switching elements, the switching unit is electrically connected to the ground portion, the switching elements are connected in parallel, one end of each switching element is electrically connected to the switching unit, and the other end of each switching element is grounded; wherein through controlling the switching unit, the switching unit switches to connect with different switching elements to adjust the first frequency band.

17. The wireless communication device of claim 10, wherein the antenna structure further comprises a third antenna and a fourth antenna, the third antenna and the fourth antenna are positioned opposite to the first antenna and the second antenna, the third antenna and the fourth antenna are positioned adjacent to the fourth frame, a structure of the third antenna is the same as the structure of the first antenna, and a structure of the fourth antenna is the same as the structure of the second antenna.

18. The wireless communication device of claim 17, wherein the first antenna is a main antenna and the third antenna is a diversity antenna.

19. The wireless communication device of claim 17, wherein the third antenna is a diversity antenna and the fourth antenna is a Global Positioning System (GPS) antenna, the third antenna and the fourth antenna are both electrically connected to a duplexer to achieve a separation of signals.

* * * * *